United States Patent [19]

Thomas

[11] Patent Number: 4,832,097

[45] Date of Patent: May 23, 1989

[54] BASKET WEAVING FORM

[76] Inventor: Janice S. Thomas, 517 5th Avenue Dr. East, Bradenton, Fla. 34208

[21] Appl. No.: 212,285

[22] Filed: Jun. 27, 1988

[51] Int. Cl.[4] ..... B27J 1/02

[52] U.S. Cl. ..... 147/48

[58] Field of Search ..... 147/48; 217/122, 123, 217/124, 125, 64

[56] References Cited

U.S. PATENT DOCUMENTS

| | | | |
|---|---|---|---|
| 165,417 | 7/1875 | Jones | 217/122 |
| 198,289 | 12/1877 | Fox | 217/122 |
| 512,404 | 1/1894 | Springer et al. | 217/123 |
| 763,580 | 3/1904 | Walker | 217/122 |
| 1,243,081 | 10/1917 | Lloyd | 147/48 |
| 1,311,086 | 7/1919 | Loughlin et al. | 217/122 |
| 1,704,876 | 3/1929 | Weber | 147/48 |
| 1,770,613 | 7/1930 | Hatch | 147/48 |
| 1,848,897 | 3/1932 | McAlvay | 147/48 |
| 1,912,303 | 5/1933 | Phelps | 147/48 |
| 1,933,879 | 11/1933 | Thayer | 147/48 |
| 2,787,821 | 4/1957 | Shukait | 217/122 X |
| 4,678,016 | 7/1987 | Hall | 147/48 |

*Primary Examiner*—Mark Rosenbaum
*Assistant Examiner*—Peter D. B. Vo
*Attorney, Agent, or Firm*—Charles J. Prescott

[57] ABSTRACT

A basket weaving form and method for use in conjunction with the contouring and weaving of a domed basket base. The invention includes a spider support having a contoured surface shaped similar to that of the under side of a desired basket base configuration. The spider support is adapted to receive a pin or nail previously pierced through the overlapping mid-point of a plurality of uniformally arranged, radially extending weaving spokes. Once thus temporarily afixed atop the basket weaving form, the spokes then forming a basket spider may be securely shaped over the spider receiving surface as lengths of weavers are woven back and forth around the weaving spokes to form the basket base.

7 Claims, 2 Drawing Sheets

Fig. 2
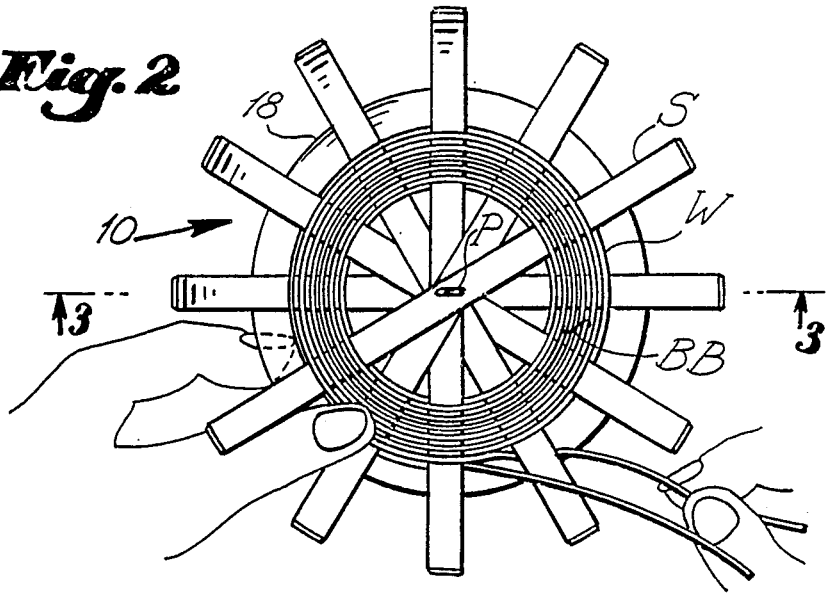
Fig. 3
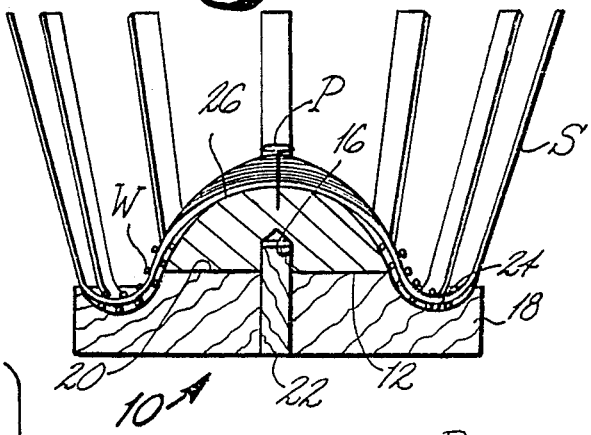
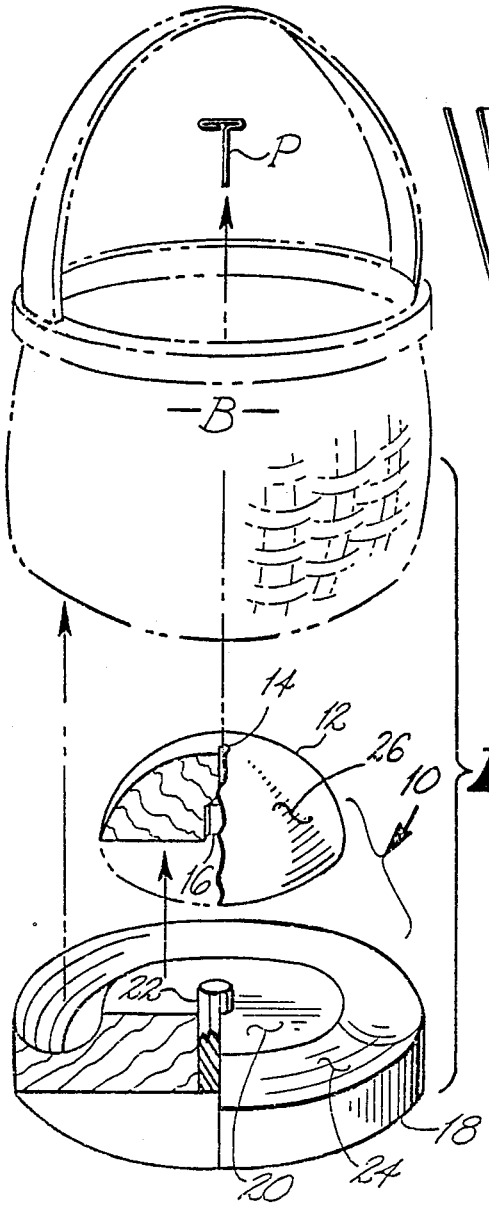
Fig. 1
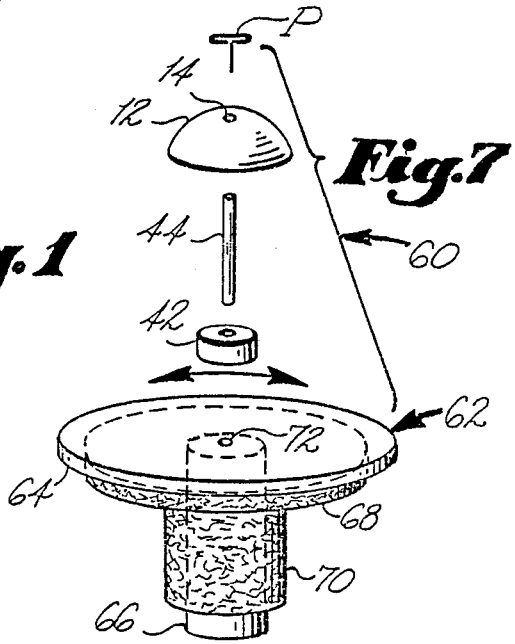
Fig. 7

BASKET WEAVING FORM

BACKGROUND OF THE INVENTION

This invention relates generally to articles and methods of manufacturing woven baskets, and more particularly to a basket weaving form for use in contouring a spoked basket base.

Applicant is aware of the use of plugs or molds as an almost ancient technique for the hand fabrication of a woven spoked basket. Moving beyond the use of one's knee to form the domed central portion of the basket base, these ancient molds have been used in several forms; however, all are generally directed to a rigid three dimensional form which conforms with the interior surface of the to-be-fabricated basket whereby the mold acts as a male "plug" to be removed from the interior of a basket when complete.

Applicant is also aware of three basket making machines as disclosed in U.S. Pat. No. 1,933,879 to Thayer, U.S. Pat. No. 2,265,820 to Scanlan, and U.S. Pat. No. 4,678,016 to Hall, However, both the operational concept and components thereof, as well as the baskets themselves, are dissimilar to that of the present invention.

Applicant is further aware of several basket designs as disclosed in U.S. Pat. No. 1,311,086 to O'Loughlin, U.S. Pat. No. 763,580 to Walker, and U.S. Pat. No. 124,231 to Tower. However, none of these baskets even include a generally concave basket base which is facilitated by the present invention.

The present invention discloses a basket weaving form and method of manufacturing a spoked basket which has a generally dome-shaped central base portion formed initially of a spider web having a plurality of crossing and radially extending spokes. The invention provides a convenient means for both attaching and securing the spider web to the invention, as well as providing a virtually unlimited number of basket base contours into which the spider web may be woven into any desired basket base configuration accurately and consistently.

BRIEF SUMMARY OF THE INVENTION

This invention is directed to a basket weaving form and method for use in conjunction with the contouring and weaving of a domed basket base. The invention includes a spider support having a contoured surface shaped similar to that of the under side of a desired basket base configuration. The spider support is adapted to receive a pin or nail previously pierced through the overlapping midpoint of a plurality of uniformally arranged, radially extending weaving spokes. Once thus temporarily affixed atop the basket weaving form, the spokes then forming a basket spider may be securely shaped over the spider receiving surface as lengths of weavers are woven back and forth around the weaving spokes to form the basket base.

It is therefore an object of this invention to provide a basket weaving form and method of manufacturing for use in conjunction with the easy, convenient, accurate and consistent formation of the generally dome-shaped spoked basket bases.

It is another object of this invention to provide an inexpensive means for conveniently and uniformly producing the base of a hand woven spoked basket.

It is yet another object of this invention to provide a secondary recurve form to facilitate the uniform hand weaving of the upwardly contoured outer portion of a basket base.

It is yet another object of this invention to provide a means of stabilizing the spider web and weavers during the initial hand weaving of a spoked basket base.

In accordance with these and other objects which will become apparent hereinafter, the instant invention will now be described with reference to the accompanying drawings in which:

BRIEF DESCRIPTION OF THE DRAWINGS

FIG. 1 is an exploded perspective view of the preferred embodiment of the invention showing the completed woven basket in phantom.

FIG. 2 is a top plan view of the inside of the central portion of a basket bottom with the invention in place there beneath.

FIG. 3 is a section view in the direction of arrows 3-3 in FIG. 2.

FIG. 7 is an exploded perspective view of an alternate embodiment of the invention shown in FIG. 5.

DETAILED DESCRIPTION OF THE INVENTION

Figure 4:
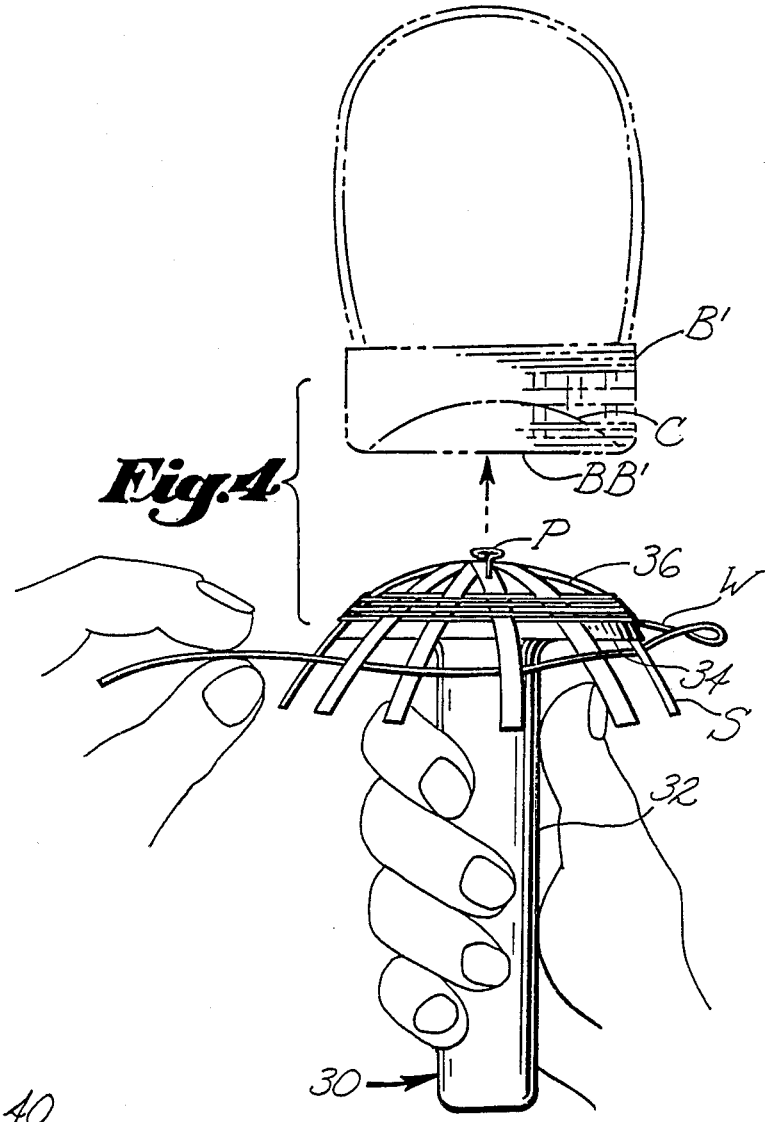
FIG. 4 is a side elevation view of another embodiment of the invention showing the completed basket in phantom.

Referring now to the drawings, and particularly to FIGS. 1 to 3, the preferred embodiment of the invention is shown generally at 10 and includes domed, preferably convex basket base spider support 12 and secondary recurve form 18, both preferably fabricated of wood. Spider support 12 is made connectable to secondary form 18 via pin 22 which extends upwardly from surface 20 into aperture 16 in the bottom of spider support 12.

Spider support 12 includes a basket spider receiving surface 26 which is contoured at the user's discretion to be similar to the central portion of the bottom surface of the desired basket base BB. As best seen in FIGS. 2 and 3, the beginnings of a basket B comprise a plurality of spider spokes S which are arranged to cross atop one another at their mid-point and held in an evenly distributed radially extending array by pin P which is pierced therethrough. Ordinarily the user then begins to intertwine weavers W back and forth in increasing circular fashion around this mid-point and pin P, perhaps using one's knee as a shaping guide. However, the present invention provides the spider support 12 having aperture 14 into which pin P may then be inserted and releasably retained and used to shape and retain the spider web SW and resulting basket base BB as will be described herebelow.

Once the spider web SW, formed initially of a plurality of connected spokes S as previously described, is in place in its initial flattened configuration atop spider support 12, the spokes S, preferably moistened to enhance flexibility, are then pushed downwardly over surface 26 and, thereafter, weavers W are intertwined from the center of the spider web outwardly as shown. The weavers W then assist in retaining the shaped spider web SW in the configuration of surface 26 as they begin to form the basket base BB. Additionally, the spider web SW will adopt a very uniform concave or dome shape when conveniently connected by pin P into aperture 14 atop surface 26 as the remainder of the weavers W are manipulated around spokes S to complete the base BB of basket B.

Although in its broadest form, the invention includes only spider support 12 which facilitates the formation of the spider web SW and the central portion of basket base BB, the preferred embodiment also includes the secondary recurve form 18 which is made connectable to the bottom surface of spider support 12 as previously described. Thus, when the weavers W have extended outwardly to the perimeter 28 of spider support 12, the secondary recurve 18 facilitates the redirecting of spokes S upwardly in a uniform concave contour 24 (convex with respect to basket bottom BB). Once the moistened spokes S are thus redirected upwardly, weavers W may be manipulated in the conventional fashion therearound to complete the basket base BB.

Once the basket base BB is completed, either or both spider support 12 and secondary recurve 18 may be removed therefrom. However, it is preferred that spider support 12 remain in place during the remainder of the basket weaving to insure that the basket base BB retains its desired uniform configuration until the basket is fully complete.

Referring now to FIG. 4, another embodiment of the invention is shown generally at 30 and includes spider support 34 having an upper basket base receiving surface 36 generally as previously described, except with respect to overall smaller size. This embodiment 30 also includes handle 32 which is downwardly disposed away from the bottom therefor of spider support 34 to facilitate handling of the spider web SW connected atop spider receiving surface 36 by pin P as previously described.

In this embodiment 30, the overall size and configuration are adapted particularly for very small baskets, B' having an almost completely concave basket base BB' contour C. By being able to conveniently hold the smaller spider web SW in place affixed atop spider receiving surface 36, the user may manipulate the weavers W without undue interference in conjunction with the holding of the assembly in the other hand.

Figure 5:
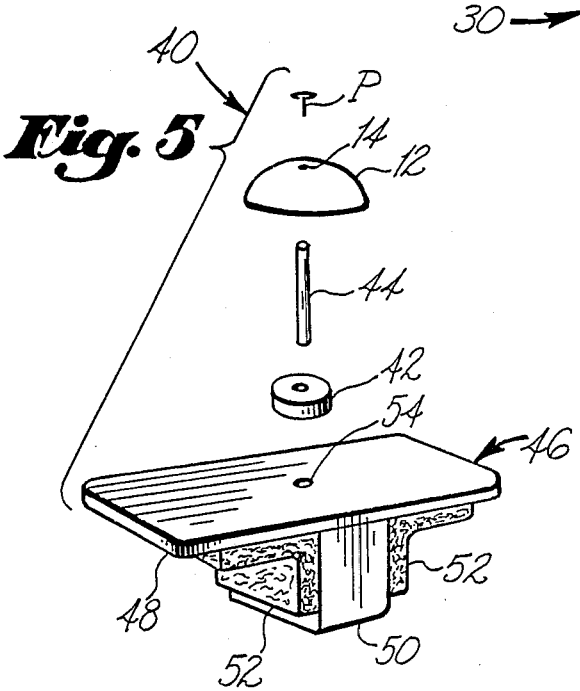
FIG. 5 is an exploded perspective view of yet another embodiment of the invention.
Figure 6:
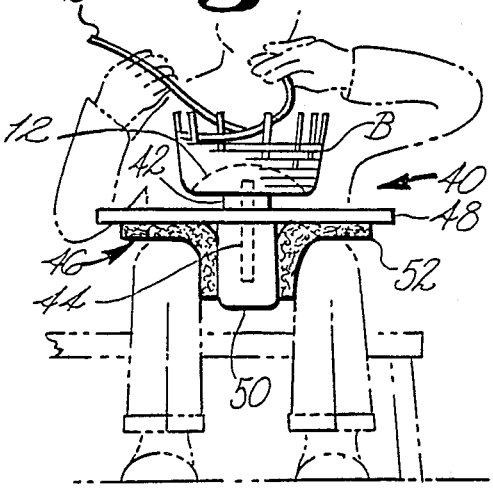
FIG. 6 is a pictorial view of the embodiment of the invention shown in FIG. 5 in use.

Referring now to FIGS. 5 and 6, another embodiment of the invention is shown generally at 40 and is adapted to facilitate the use of a user's lap and upper legs to hold the work assembly 40 so that both hands are free to accomplish the weaving process. This embodiment 40 includes the same spider support 12 having aperture 14 as previously described which is adapted to releasably retain pin P in place therein after it has been pierced through the central portion of the spokes S. Knee support 46 is also provided having rigid upper platform 48 rigidly connected to a downwardly disposed central portion 50. The bottom surfaces of both of these members are foam covered at 52 to facilitate more comfortable long term use. The overall shape of knee support 46 is adapted, as best seen in FIG. 6, to fit atop and between the user's knees to support the basket B which is connected to spider support 12 as previously described. The spider support 12 is then made connectable to knee support 46 via shaft 44 and spacer 42 which align to allow shaft 44 to pass into aperture 54 and into the opposing aperture 16 in spider support 12 as best seen in FIG. 1.

Referring now to FIG. 7, an alternate embodiment of the invention as shown in FIGS. 5 and 6 is there shown at 60. This embodiment 60 includes the same spider support 12, shaft 44 and spacer 42. However, the knee support 62 includes a rigid circular platform 64 and cylindrical downward extension 66, both of which are foam covered at 68 and 70 for comfort and convenience. This embodiment 60 facilitates the easy and convenient rotational repositioning in the direction of the arrow within and atop the user's knees to expedite the process of weaving.

It should be noted that although the basket spider (web) receiving surface which forms all or the central portion of the basket base has been generally described as domed, convex or contoured, virtually any other regular three-dimensional shape imaginable is intended to be encompassed and within the scope of this invention.

While the instant invention has been shown and described herein in what is conceived to be the most practical and preferred embodiment, it is recognized that departures may be made therefrom within the scope of the invention, which is therefore not to be limited to the details disclosed herein, but is to be accorded the full scope of the claims so as to embrace any and all equivalent apparatus and articles.

What is claimed is:

1. A basket weaving form for receiving and shaping a basket spider of a base in a basket, the base having a generally concaved central portion, the basket spider formed of a plurality of crossing and radially extending weaving spokes, said form comprising:

a rigid spider support having a contoured upper surface and a bottom surface, said upper surface shaped similarly to a particular configuration of the central portion;

said spider support configured to supportively receive and releasably retain a pin and the basket spider atop said upper surface, the pin first pierced through the crossing weaving spokes and then centrally into said upper surface whereby the basket spider may be downwardly shaped into the central portion over said upper surface.

2. A basket weaving form as set forth in claim 1, wherein:

said spider support is adapted in overall size to shape the basket spider over substantially the entire basket base configuration.

3. A basket weaving form as set forth in claim 1, further comprising:

a basket spider secondary form connected beneath and against said bottom surface and radially outwardly extending from said spider support;

said secondary form adapted to upwardly redirect and shape the portion of the basket spider extending radially beyond said spider support to form substantially the entire basket base.

4. A basket weaving form as set forth in claim 3, wherein:

said spider support and said secondary form are separable.

5. A basket weaving from as set forth in claim 1, further comprising:

a handle connected to said spider support extending downwardly from said bottom surface.

6. A basket weaving form as set forth in claim 1, further comprising:

a knee support connectable to said spider support extending downwardly from said bottom surface configured to be supported atop and between a seated user's upper legs.

7. A basket weaving form as set forth in claim 6, wherein:

said knee support is circular and configured to facilitate convenient rotational reorientation during use.

* * * * *